US010662596B2

(12) United States Patent
Barbrey et al.

(10) Patent No.: US 10,662,596 B2
(45) Date of Patent: May 26, 2020

(54) DEPLOYABLE TIRE DEFLATOR

(71) Applicant: Roadlink, LLC, Fountain Inn, SC (US)

(72) Inventors: J. Michael Barbrey, Fountain Inn, SC (US); John O. Roper, Fountain Inn, SC (US)

(73) Assignee: Roadlink, LLC, Fountain Inn, SC (US)

( * ) Notice: Subject to any disclaimer, the term of this patent is extended or adjusted under 35 U.S.C. 154(b) by 0 days.

(21) Appl. No.: 16/209,057

(22) Filed: Dec. 4, 2018

(65) Prior Publication Data

US 2019/0169808 A1 Jun. 6, 2019

Related U.S. Application Data

(60) Provisional application No. 62/595,164, filed on Dec. 6, 2017.

(51) Int. Cl.
*E01F 13/12* (2006.01)

(52) U.S. Cl.
CPC ..... *E01F 13/12* (2013.01)

(58) Field of Classification Search
CPC ..... E01F 13/12; E05B 63/24
See application file for complete search history.

(56) References Cited

U.S. PATENT DOCUMENTS 4,804,070 A * 2/1989 Bohler ..... B60R 25/09 188/32
5,247,815 A * 9/1993 Caldwell ..... B60R 25/093 188/32
5,775,832 A * 7/1998 Kilgrow ..... E01F 13/12 404/6
5,839,849 A * 11/1998 Pacholok ..... B60R 25/00 404/6
6,155,745 A * 12/2000 Groen ..... E01F 13/12 404/6
6,430,769 B1 * 8/2002 Allen ..... A61G 3/061 14/69.5
6,623,205 B1 * 9/2003 Ramirez ..... E01F 13/12 404/6
6,749,362 B1 * 6/2004 Eichenberg ..... E01F 13/12 404/6
6,869,248 B1 * 3/2005 Threlkeld ..... E01F 13/12 404/6
6,994,488 B2 * 2/2006 Crowley, Sr. ..... E01F 13/12 404/6
7,186,052 B2 * 3/2007 Rom ..... B60R 25/09 404/6
7,824,126 B2 * 11/2010 Costa ..... E01F 13/12 180/274

(Continued)

*Primary Examiner* — Abigail A Risic
(74) *Attorney, Agent, or Firm* — JK Intellectual Property Law, PA

(57) ABSTRACT

A deflator deployable on the ground adjacent a tire may include a base member, a body member having a first end attached to the base member and having a handle portion spaced upward from the base member when the bottom surface of the base member is placed on the ground, and two arms. Each arm may a first end pivotally attached to the base member and a second end extending away from the first end. Each arm may have a puncturing member located adjacent the second end. A release mechanism may be located on the body member adjacent to the handle portion and may be movable from a hold position to a release position.

9 Claims, 9 Drawing Sheets

(56) References Cited

U.S. PATENT DOCUMENTS

| | | | | |
|---|---|---|---|---|
| 8,087,847 | B2 * | 1/2012 | Scott | E01F 13/12 124/1 |
| 8,132,980 | B1 * | 3/2012 | Lee | E01F 13/12 180/287 |
| 8,365,358 | B1 * | 2/2013 | Bredl | E05F 1/068 16/309 |
| 8,777,511 | B1 * | 7/2014 | Rose | E01F 13/12 404/6 |
| 9,297,128 | B1 * | 3/2016 | Tang | E01F 13/12 |
| 2004/0101361 | A1 * | 5/2004 | Eichenberg | E01F 13/12 404/6 |
| 2004/0190990 | A1 * | 9/2004 | Blair | E01F 13/105 404/6 |
| 2005/0089368 | A1 * | 4/2005 | Crowley, Sr. | E01F 13/12 404/6 |
| 2005/0089369 | A1 * | 4/2005 | Crowley, Sr. | E01F 13/12 404/6 |
| 2005/0147466 | A1 * | 7/2005 | Crowley, Sr. | E01F 13/12 404/73 |
| 2005/0265781 | A1 * | 12/2005 | Blair | E01F 13/12 404/6 |
| 2011/0097147 | A1 * | 4/2011 | Castro | E01F 13/12 404/6 |
| 2011/0135385 | A1 * | 6/2011 | Washington | E01F 13/12 404/6 |
| 2018/0320327 | A1 * | 11/2018 | Foster | E01F 13/12 |

* cited by examiner

DEPLOYABLE TIRE DEFLATOR

CROSS-REFERENCE TO RELATED APPLICATION

The present application is a Non-Provisional patent application and claims priority to U.S. Provisional Patent Application Ser. No. 62/595,164, filed Dec. 6, 2017, which is incorporated by reference herein.

TECHNICAL FIELD

The present disclosure relates generally to device for placement adjacent a vehicle tire during a traffic stop to deflate the tire if the vehicle drives away before the traffic stop is completed. More particularly, the present disclosure relates to such a device that can be safely and efficiently deployed when the traffic stop begins.

BACKGROUND

When a law enforcement officer makes a traffic stop, the officer exits his or her vehicle and approaches the stopped vehicle, generally by walking beside one of the driver or passenger sides of the stopped vehicle. During the portion of the traffic stop that the law enforcement officer is outside of his or her vehicle, the officer is in some ways more physically exposed than when in his or her vehicle in case the driver or another occupant of the car does something unexpected, such as driving off, driving toward the officer or the officer's vehicle, reaching for or using a weapon, attempting to dispose of contraband, etc. It is thus important for the law enforcement officer to maintain observational awareness of the stopped vehicle, all occupants, and the general surroundings during this time for the officer's own safety and for detecting important information relative to any legal or safety violations related to the stopped vehicle or its occupants.

Also, in many routine traffic stops, the law enforcement officer also returns to his or her own vehicle after initial contact on tasks such as communicating with other officers, checking occupant or vehicle information electronically or via two-way communication device, preparing a traffic citation, etc. At such point, while the law enforcement office may have attention focused on such tasks, it may be more difficult to monitor the stopped vehicle and its occupants. Such point is a time when some drivers of stopped vehicles drive off before being dismissed by the law enforcement officers.

Accordingly, certain devices have been developed for placement near the tire of a stopped vehicle that will puncture the tire if the vehicle is driven away before the stop is completed. The devices also serve to influence the driver of a stopped vehicle not to flee by driving away before being dismissed, as the driver would know doing so would result in a deflated tire rendering fleeing by vehicle futile. While existing devices work well for their intended purposes, deployment of existing devices requires a certain amount of the law enforcement officer's line of sight and attention in general to be diverted away from the vehicle and its occupants and toward deploying the devices around a tire.

Accordingly, improvements would be welcome for devices that disable a vehicle, influence a driver not to drive away, reduce danger to a law enforcement officer, and/or address one or more drawbacks of current devices or any other issues.

SUMMARY

According to certain aspects of the disclosure, a deflator deployable on the ground adjacent a tire may include a base member having a bottom surface configured for placement on the ground, and a body member having a first end attached to the base member and having a handle portion spaced upward from the base member when the bottom surface of the base member is placed on the ground. Two arms may be provided, each arm having a first end pivotally attached to the base member and a second end extending away from the first end, each arm being pivotable between a first position in which the second end is located adjacent the body member and a second position in which the second end is pivoted into a position away from the body member. Each arm may have a puncturing member located adjacent the second end. When the second ends of the arms are in the second position the puncturing members are spaced apart at a deploying distance more than a front-rear dimension of the tire proximate the ground. A release mechanism is located on the body member adjacent to the handle portion and movable from a hold position to a release position, the release mechanism including two tabs extending outward from the body member, each tab configured to hold a respective one of the arms in the first position when the release mechanism is in the hold position and to allow the arms to move to the second position when the release mechanism is moved to the release position, movement of the arms to the second position locating the puncturing members at the deploying distance. Various options and modifications are possible.

According to certain other aspects of the disclosure, a deflator deployable on the ground adjacent a tire may include a base member having a bottom surface configured for placement on the ground, and a body member having a first end attached to the base member and having a handle portion spaced upward from the base member when the bottom surface of the base member is placed on the ground. Two arms are provided, each arm having a first end pivotally attached to the base member and a second end extending away from the first end, each arm being pivotable between a first position in which the second end is located adjacent the body member and a second position in which the second end is pivoted into a position away from the body member. Each arm may have a puncturing member located adjacent the second end. Each arm may be pivotally attached to the base via a respective hinge mechanism, each hinge mechanism defining a hinge axis extending at a first angle of about 15 to about 45 degrees relative to the horizontal, the puncturing members when the arms are in the second position being spaced apart at a deploying distance more than a front-rear dimension of the tire proximate the ground, the puncturing members and a point between the hinges arranged in a triangle shape. As above, various options and modifications are possible.

BRIEF DESCRIPTION OF THE DRAWINGS

More details of the present disclosure are set forth in the drawings.

DETAILED DESCRIPTION

Figure 1:
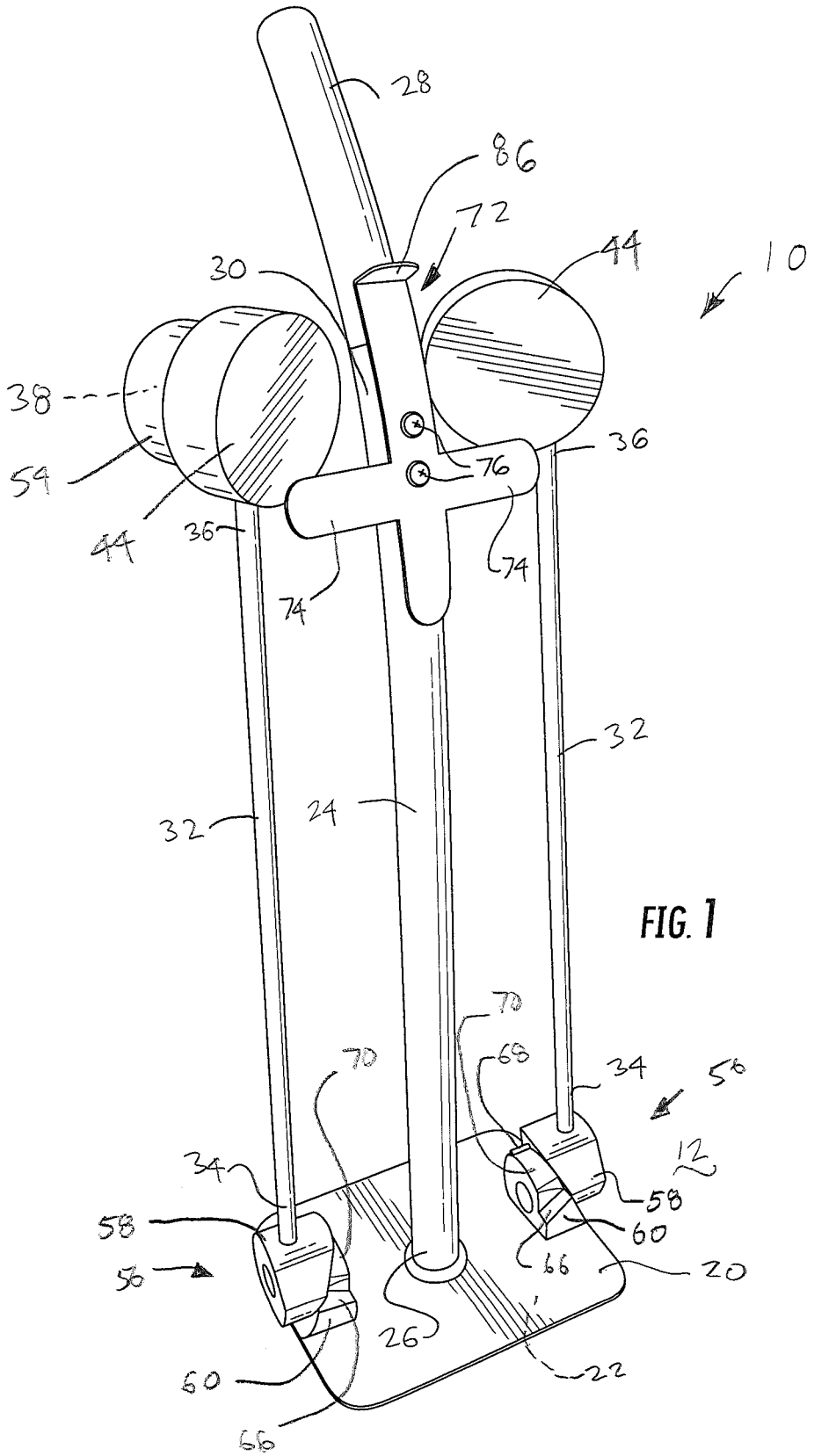
FIG. 1 is a front isometric view of a deployable tire deflator according to certain aspects of the disclosure.
Figure 2A:
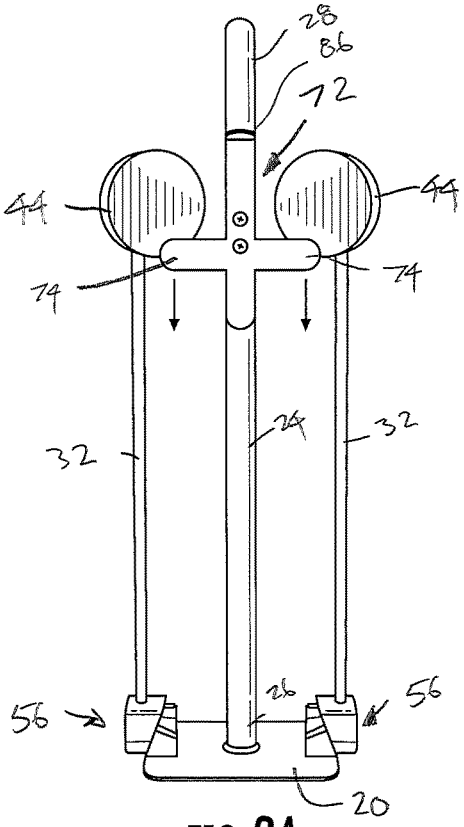
FIGS. 2A-2C are front views of the deflator of FIG. 1 showing the steps of deploying the arms of the device.
Figure 2B:
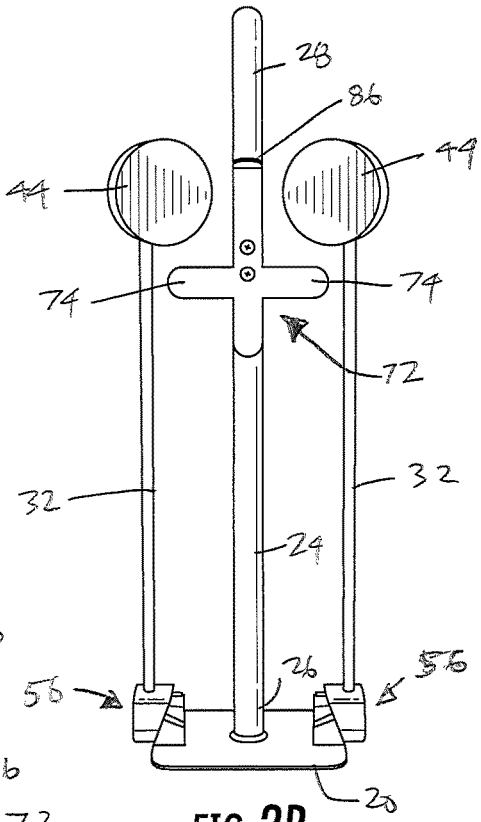
Figure 2C:
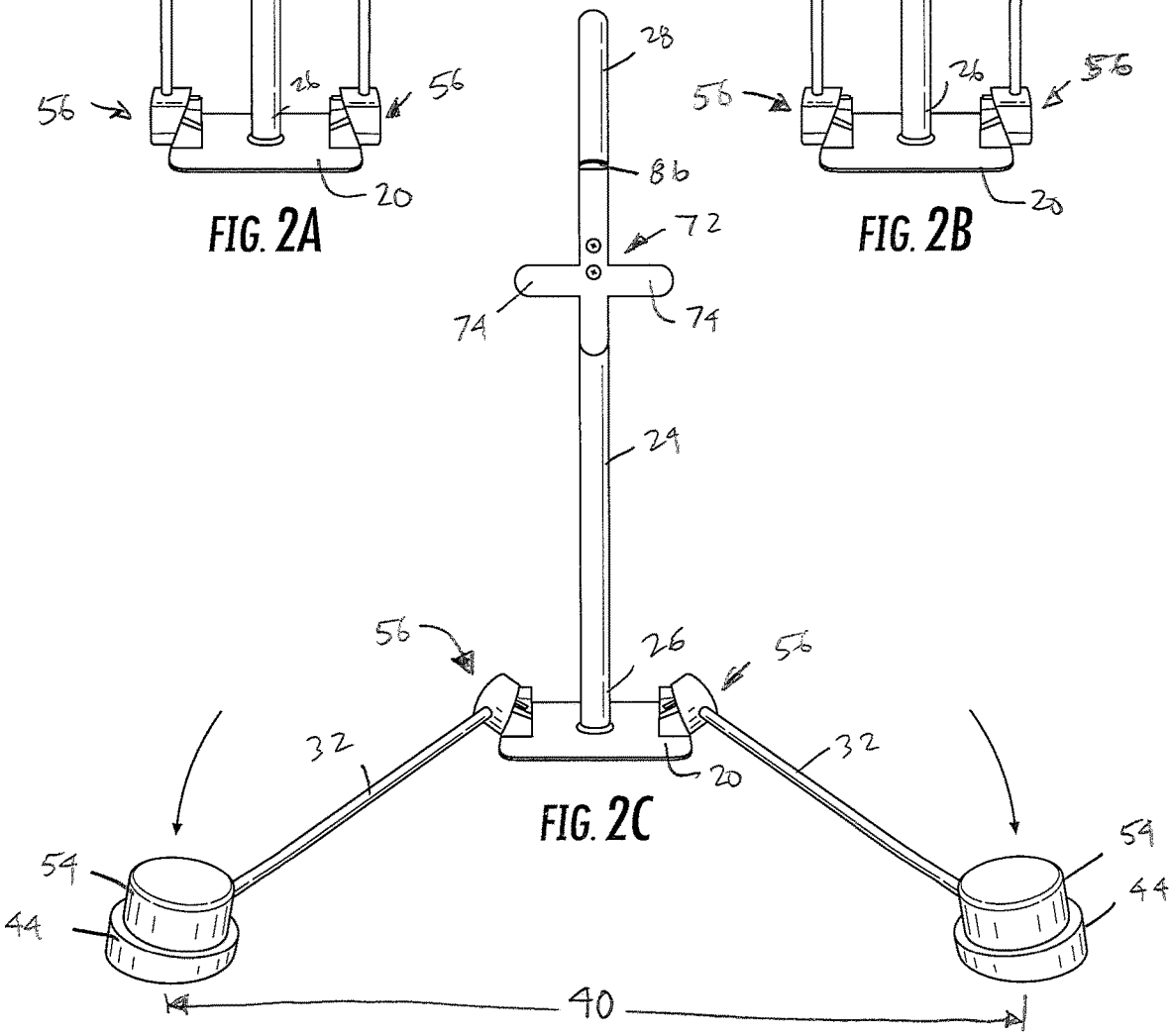
Figure 3A:
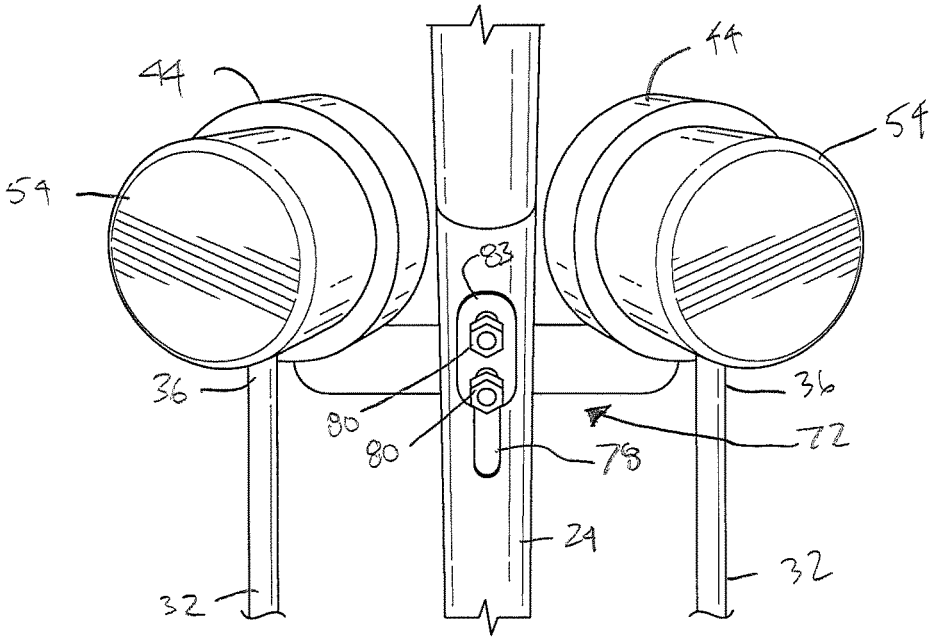
FIGS. 3A and 3B are rear close-up views of a portion of the deflator as in FIGS. 2A and 2B.
Figure 3B:
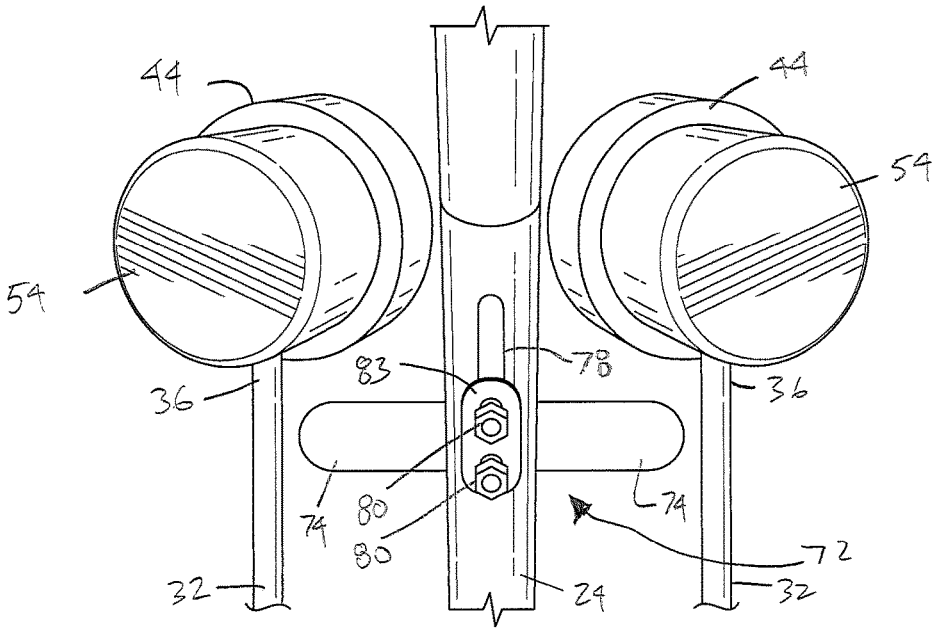
Figure 4A:
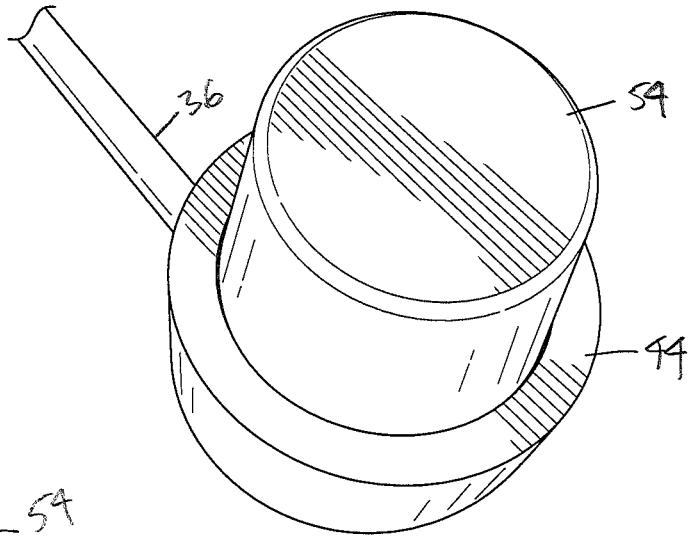
FIGS. 4A and 4B are isometric views showing respectively an assembled and two exploded optional configurations of the distal end of an arm of the deflator of FIG. 1.
Figure 4B:
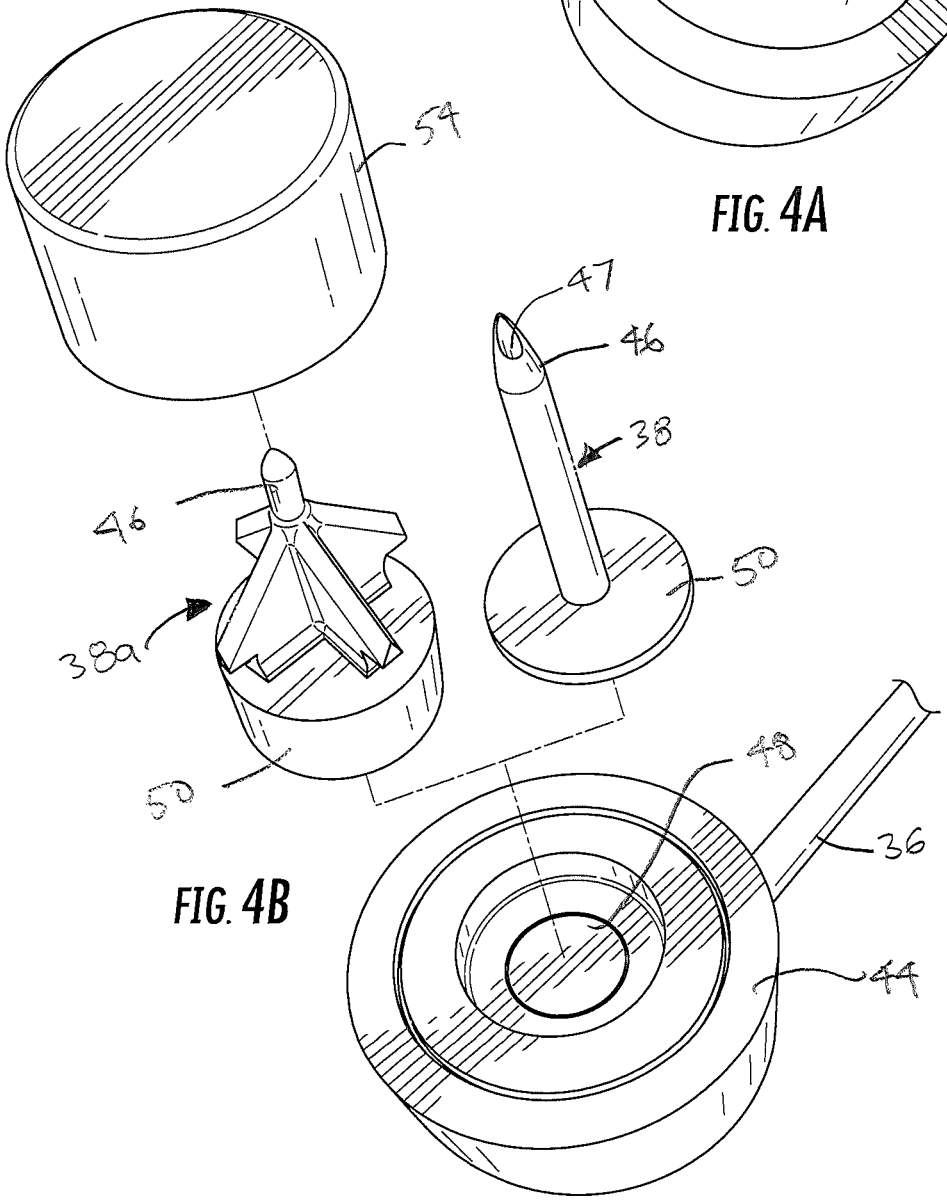
Figure 5A:
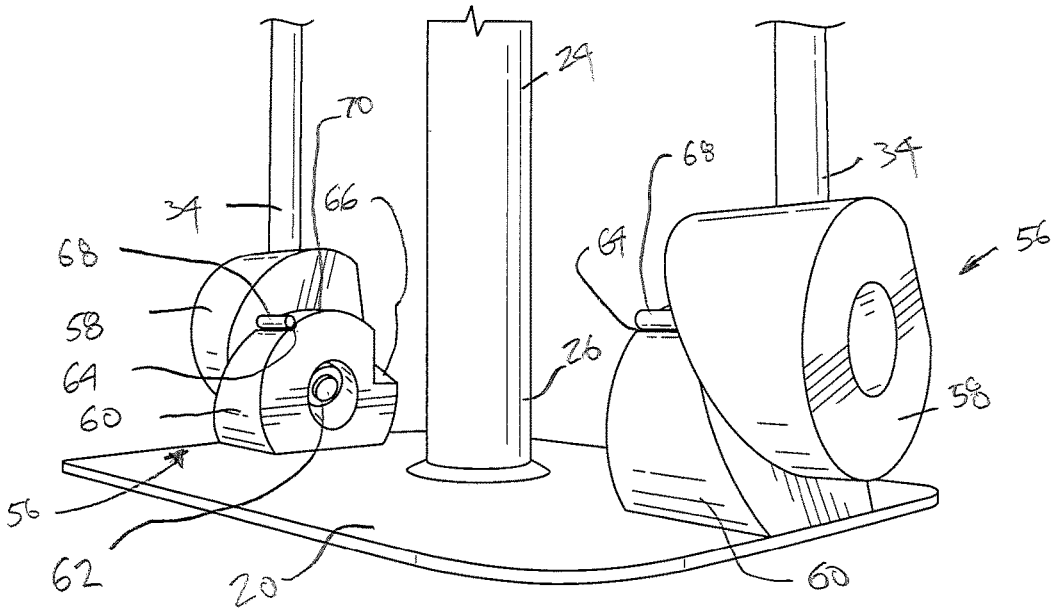
FIGS. 5A and 5B are close-up views showing the hinge assemblies when the arm is in the positions of FIGS. 2A and 2C.
Figure 5B:
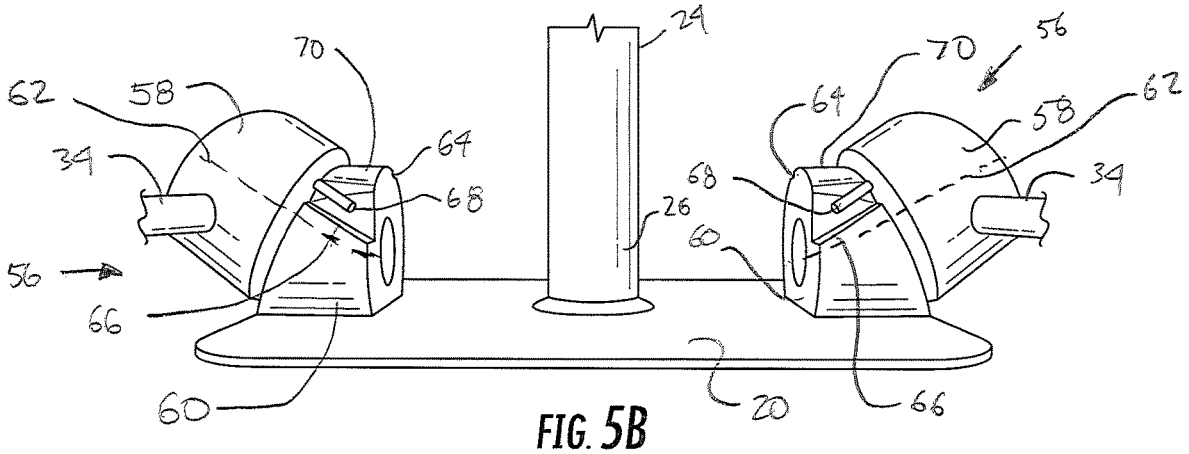
Figure 6:
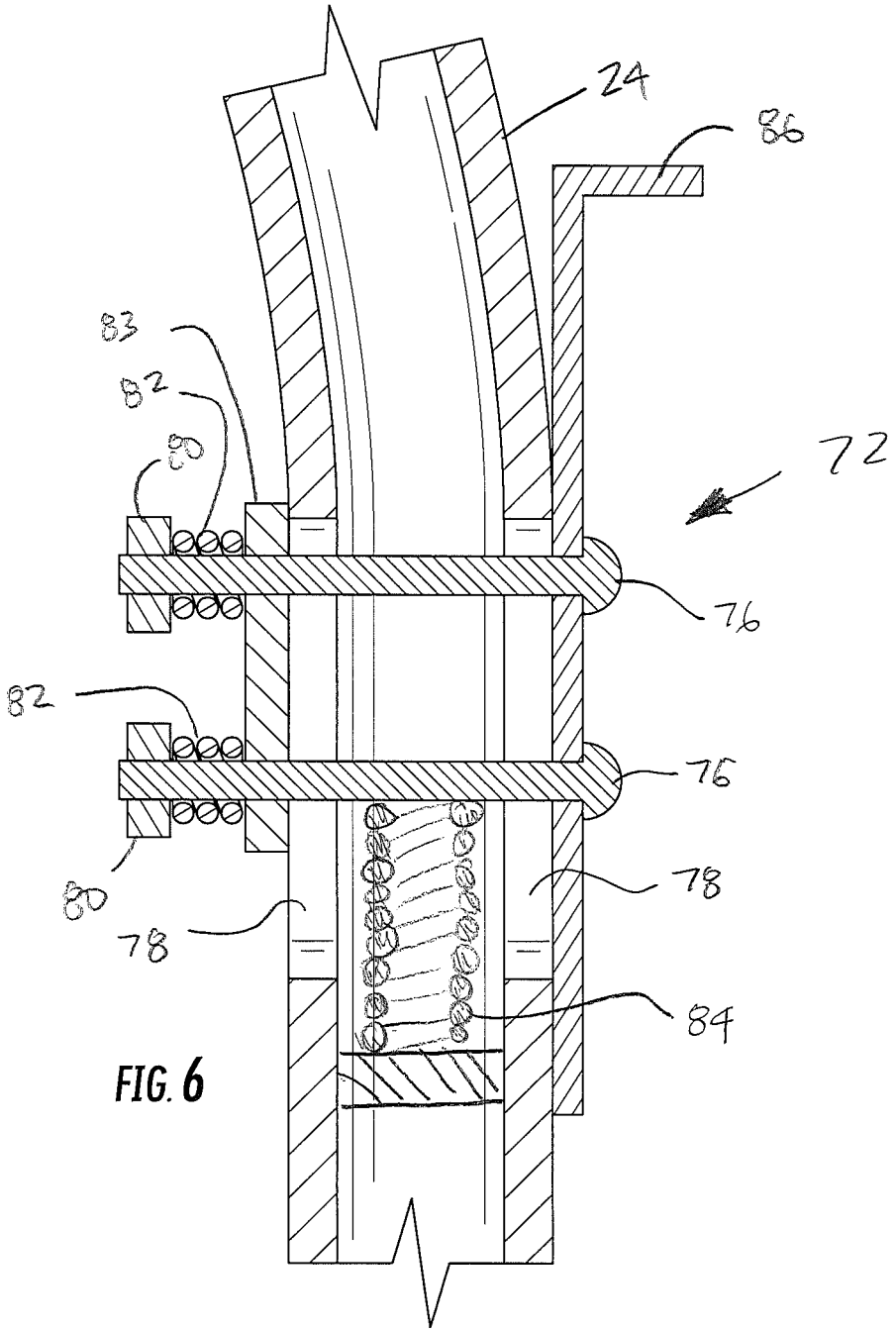
FIG. 6 is a side cross-sectional view showing the release mechanism of the deflator of FIG. 1.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Generally speaking, FIGS. 1-11 depict examples of a deflator 10 deployable on the ground 12 adjacent a tire 14 on a vehicle 16. Deflator 10 includes a hinge mechanism and a release mechanism for ready movement between a first position suitable for carrying and storage (see FIGS. 1 and 7) and a second position suitable for deployment adjacent a tire (see FIGS. 2C and 8). Operation of the hinge mechanism and the release mechanism are such that deflator 10 can if desired be deployed adjacent tire 14 with one hand and while keeping the operator's eyes elsewhere (observing vehicle 16, its occupants, passing traffic, etc.).

Deflator 10 includes a base member 20 having a bottom surface 22 configured for placement on the ground 12. As shown, base member 20 may be a generally rectangular and flat plate, although other solid or perforated configurations could be used. Base member 20 may extend wide enough to support deflator 10 and maintain it in an upright state regardless of the orientation of the movable parts of deflator 10. Also, base member 20 may be large enough to support and maintain deflator 10 in an upright orientation in case a driver of vehicle 16 drives off before a traffic stop is completed. Base member 20 may also be small enough so that deflator 10 is readily deployable and conveniently stowable when not in use. Thus, in one embodiment, base member 20 is an aluminum plate about 6.0 inches (front-to-rear)×about 7.0 inches (side-to-side).

A body member 24 may have a first end 26 attached to base member 20 and a handle portion 28 spaced upward from the base member when bottom surface 22 of the base member is placed on the ground 12. As shown, body member 24 is a rod-like member extending upwardly, and a bend 30 may be provided between base member 20 and handle portion 28 for ease of gripping. As shown, body member 24 may be attached generally centrally on base member 20 for purposes of stability. Also as shown, handle portion 28 may include surface texturing to improve gripability, although other shapes, additions and variations could also be employed on or as part of handle portion 28 to provide a reliable and comfortable grip.

Two arms 32 are provided, each arm 32 having a first end 34 pivotally attached to base member 20 and a second end 36 extending away from the first end. Arms 32 may be about 15.0 to about 24.0 inches long, and more particularly may be about 18.0 inches long. Arms 32 may be attached to base member 20 about 6.0 inches apart.

Each arm 32 is pivotable between a first position (see FIGS. 2A and 2B) in which second end 36 is located adjacent body member 24 and a second position (see FIG. 2C) in which the second end is pivoted into a position away from the body member. A puncturing member 38, 38*a* (see FIGS. 4B and 10) is located adjacent second end 36 of each arm 32, so that when the second ends of the arms are in the second position the puncturing members are spaced apart at a deploying distance 40 more than a front-rear dimension 42 of tire 16 proximate the ground 12. When arms 32 are in the second position, puncturing members 38 may be at least about 20.0 inches apart, and may be, with the arm 32 length and spacing noted above, about 24.0 inches apart. Accordingly, deflator 10 should be configured so that puncturing members 38 may be spread to deploying distance 40 wide enough (when arms 32 are in the second position) that the puncturing members are locatable generally forward and rearward of the tread surface 18 of tire 14, but not so wide that a driver driving off from a stop without permission would be able to avoid the puncturing members 38. Deflator 10 can be made in a family of differently-sized models, with one with an arm 32 sized for tires of personal vehicles, SUV's, light trucks, etc., and another with longer arms 32 sized for vehicles with larger tires, such as commercial trucks, buses, tractor trailers, etc. Also, arms 32 could be made with continuously or discretely adjustable lengths, so as to slide, telescope, etc., between sizes if a deflator capable of being used with different sized tires were desired.

Puncturing members 38 may have various different forms. For example, as illustrated, puncturing members 38 may include a housing 44 formed on or attached to arm 32 at or near second end 36. If desired, puncturing member 38 may include a spike 46 permanently (not shown) or removably (as shown) attached to housing 44. Thus, housing 44 and spike 46 may be formed so as to be magnetically securable, either by selection of materials or by addition of a magnet 48 to one or both portions. If spike 46 is to be secured to housing 44 by magnetism, magnet 48 should be selected and sized so that the resulting magnetic force is be low enough to allow spike 46 to be removed from housing 44 by the tire 14 after the tire drives across the second end. As an alternative to a magnet, spike 46 of puncturing member 38 can include a base 50 sized to freely and slidably fit within a corresponding opening 52 within housing 44, or to fit with a loose frictional fit, or to be placed with a softer, perhaps sacrificial piece removably holding spike 46 within housing 44. Any such options or other structures possible for releasably attaching puncturing member 38 to housing are possible. Spike 46 can be shaped as a tube with a central opening 47 sized to allow the tire 16 to be deflated via the central opening after the tire drives across the second end. It should thus be understood that one or more puncturing members 38 could be used on each arm 32, either permanently or removably attached to the arm, and different shapes such as spikes, tubes, blades, cones, pyramids, combinations of same, etc., could be used as puncturing members.

As shown, a cover 54 may be provided for puncturing members 38. Cover 54 may provide one or more benefits. For example, cover 54 may provide protection to the user and surroundings during storage when not in use, when being transported in a law enforcement vehicle, etc., so that the sharp puncturing member 38 does not injure or cause damage. Cover 54 may be configured to be removable before deployment, for example being held in place in an annular slot 56 in housing 44 by a loose friction fit. Alternatively, cover 54 may be left in place during deployment adjacent a tire 16. If so, cover 54 should be made from a material such as a plastic, thin enough to be crushed and allow puncturing member 38 to puncture a tire when the tire drives over it, but thick enough to provide some protection (as noted above) when not in use. The frictional fit of cover 54 to housing 44 can also incorporate base 50 of puncturing member 38, thereby at least helping to hold puncturing member 38 to housing 44.

Each arm 32 is pivotally attached to base member 20 via a respective hinge mechanism 56. As shown, hinge mechanism includes a first member 58 attached to arm 32, a second member 60 attached to base member 20, and an axle or axis 62 (which may be a non-threaded portion of a bolt, see FIG. 5A) extending through the first and second members allowing them to rotate relative to each other along the axle.

If desired, an optional internal or external coil spring (not shown) may be provided around each axle 62 to urge arms 32 toward the second (deployed) position to assist in fully deploying the arms when desired. Also, if desired, each hinge mechanism 56 may also include a first stop 64 on one of members 58 or 60 for limiting motion of respective arm 32 toward the first position and a second stop 66 for limiting motion of respective arm 32 toward the second position. As shown, stop 66 may be a shoulder and stop 64 may be a groove, but these could be reversed or other shapes could be used. One or more followers 68 on the other of members 58 or 60 may be located on hinge mechanism 56 to interact with stops 66 and 68. Follower 68 may also follow along a guide surface 70 between stops to provide a smooth movement for arms 32, if desired.

Figure 7:
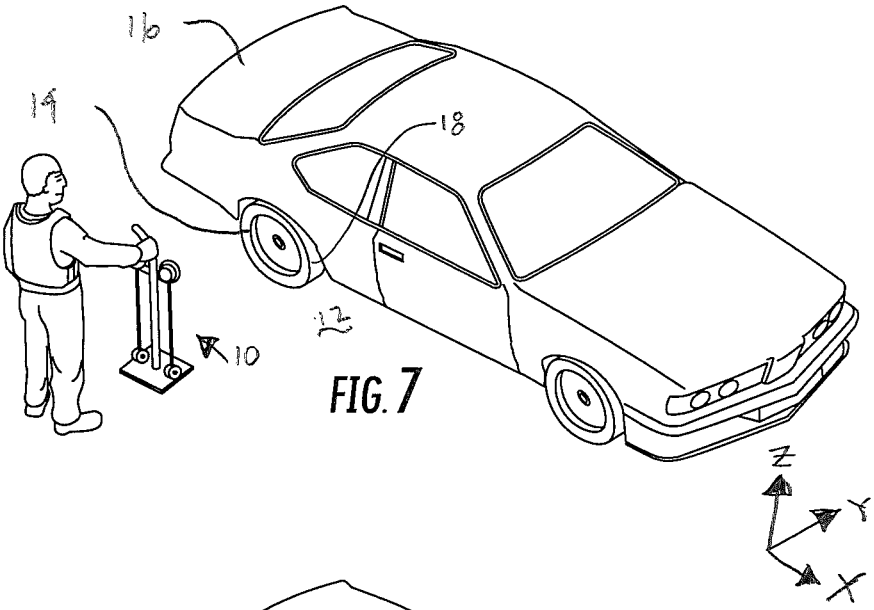
FIGS. 7-9 are isometric views showing the process by which a user deploys a deflator as in FIG. 1 adjacent a tire of a vehicle.
Figure 8:
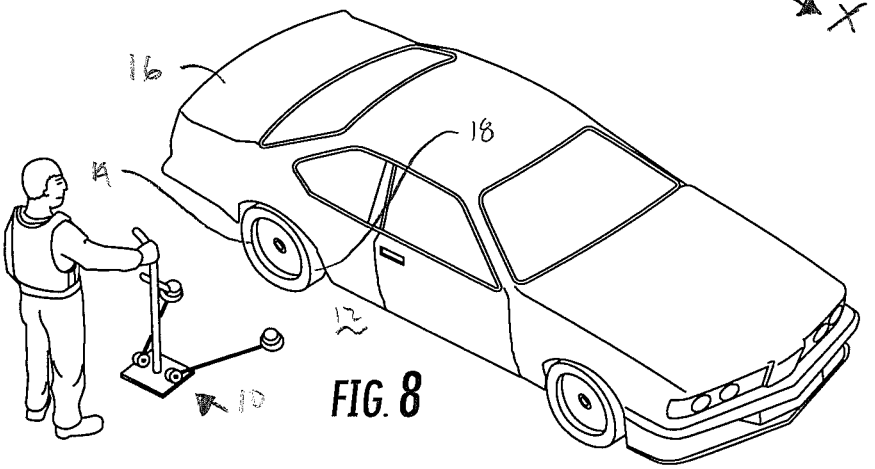
Figure 9:
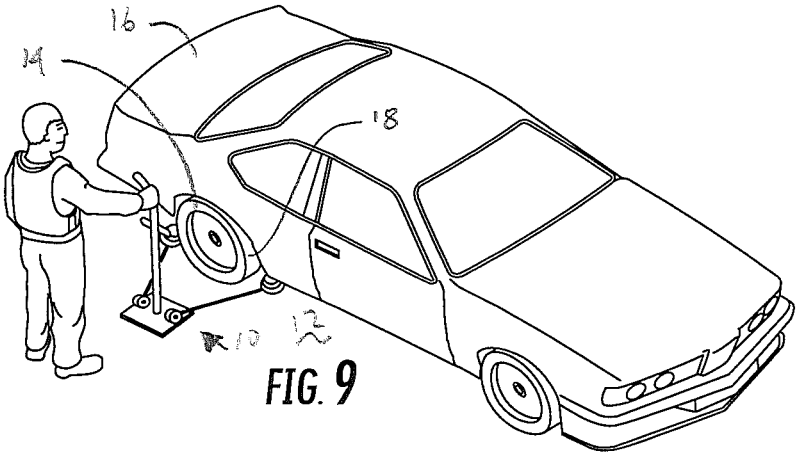
Figure 10:
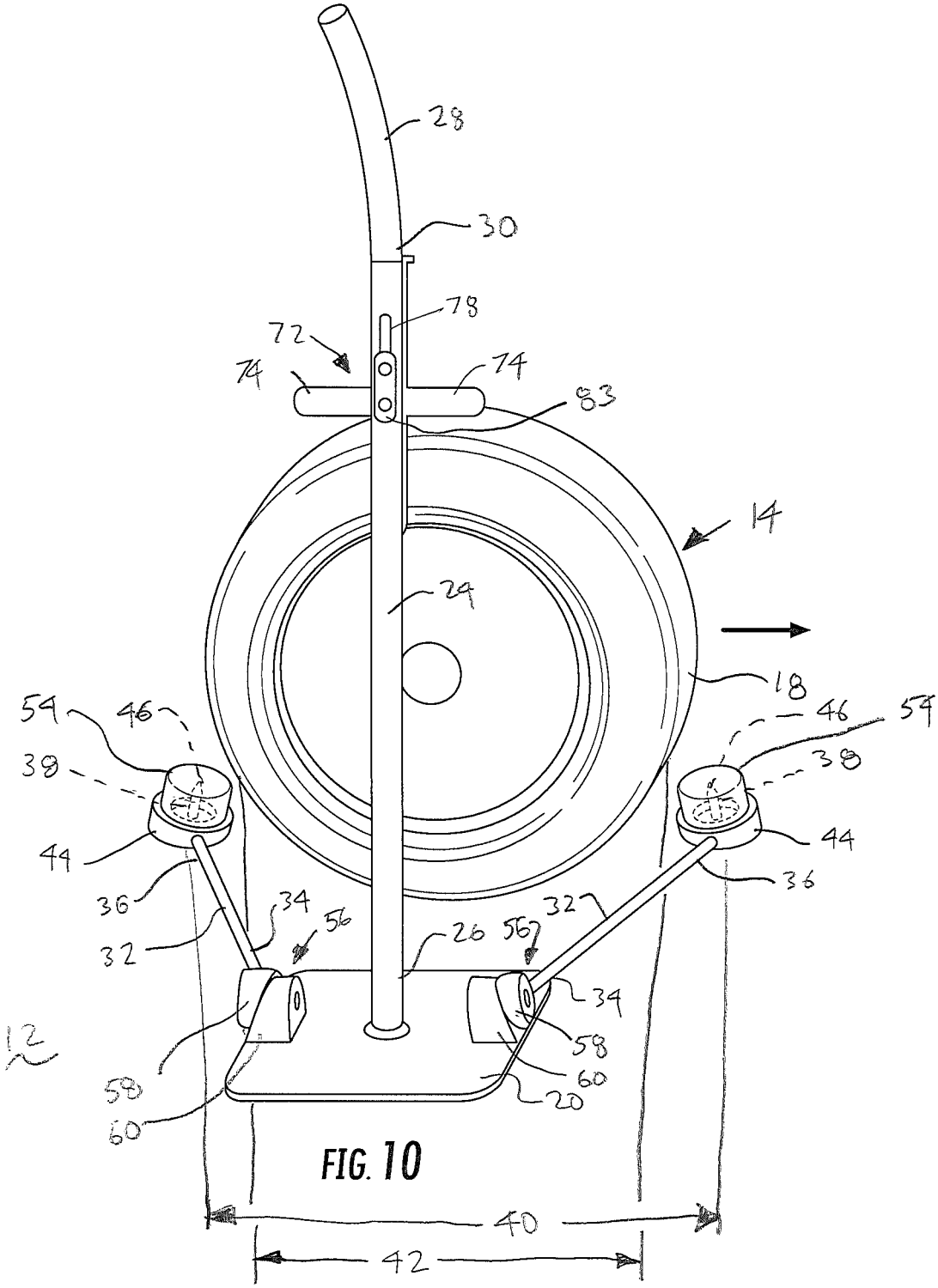
FIG. 10 is a perspective view showing a deployed deflator adjacent a tire as in FIG. 9.
Figure 11:
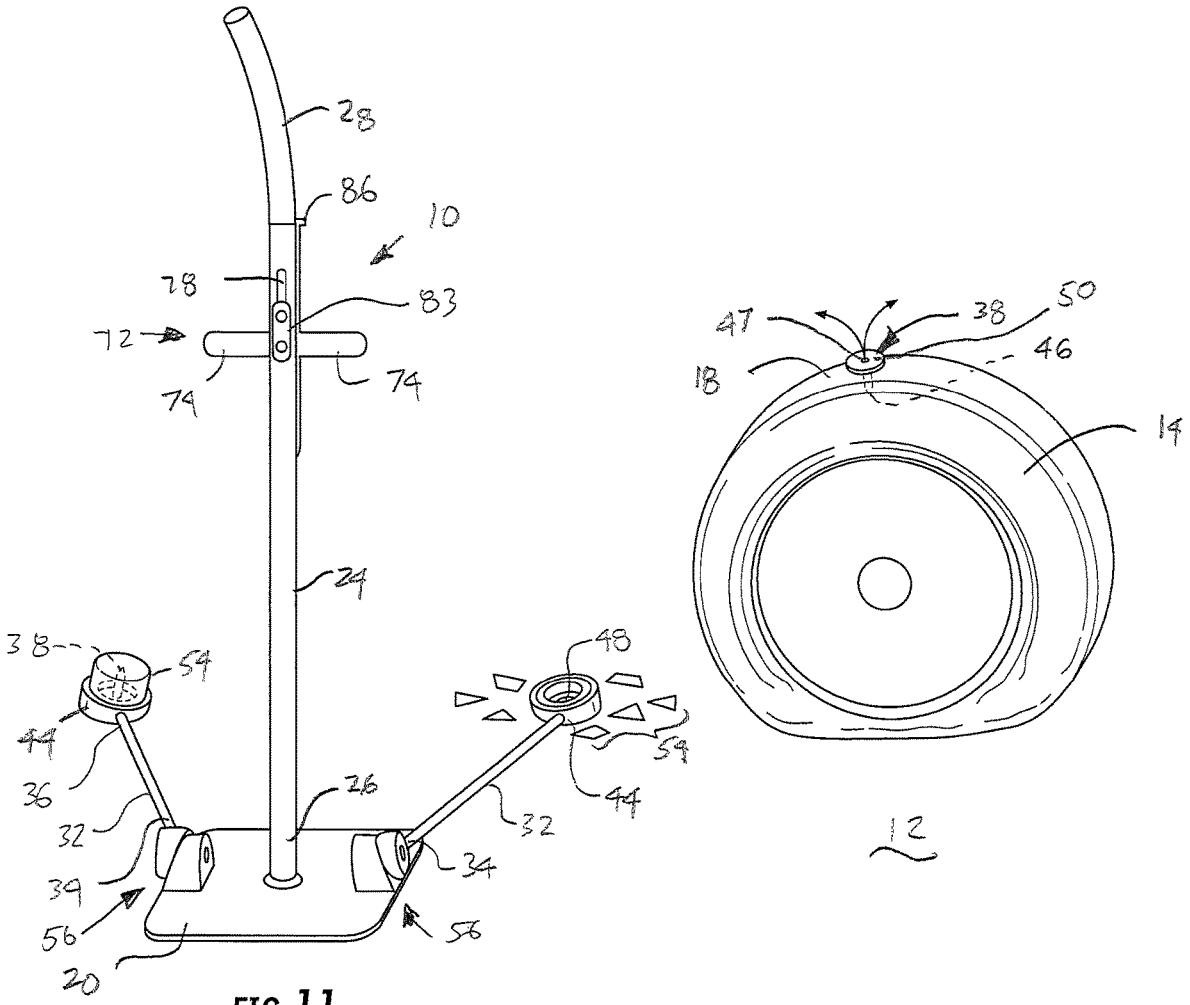
FIG. 11 is a perspective view showing a deployed deflator that has deflated a tire that drove from the position of FIG. 10 across the deflator to the position of FIG. 11.

In order to achieve the roughly triangular orientation defined by body member 24 and puncturing members 38 upon deployment of deflator 10 adjacent a tire 16, the axle of each hinge mechanism may be angled in some way away from a typical orthogonal "XYZ" frame of reference (where the X direction is a front-rear direction of the tire, the y direction is an axis of rotation direction of the tire, and the z direction is vertical—see FIG. 7). Thus, axles 62 of hinge mechanisms 56 may extend generally along the X direction, but angled upwards out of the X-Y plane parallel to the X-Z plane by about 15 to about 45 degrees, or more particularly about 30 degrees. Alternatively, axles 62 of hinge mechanisms 56 may extend parallel to the X-Y plane, but be angled laterally about 15 to about 45 degrees, or more particularly about 30 degrees from the X direction. If desired, a combination of these two non-orthogonal orientations could be employed, with differing degrees of angling in both directions. Regardless of how it is achieved, deployment from a generally compact, parallel and vertical orientation of arms 32 (FIG. 7) into a roughly triangular orientation of body member 24 and puncturing members 38 may be achieved (FIGS. 8-9), so that with base member 20 on the ground 12 adjacent the lateral (axial) side of tire 14, puncturing members 38 are located so as to be adjacent tread surface 18 of the tire.

As shown, a release mechanism 72 may be located on body member 20 adjacent to handle portion 28. Release mechanism 72 is configured to be movable from a hold position to keep arms 32 in the first position (FIGS. 2A-2B) to a release position to allow arms 32 to move (i.e., simply fall via gravity or with spring assist) toward the second position (FIG. 2C) during deployment. To stow deflator 10, arms 32 can me moved back to the first position and release mechanism can be moved back to the hold position.

As illustrated, release mechanism 72 includes two tabs 74 extending outward from body member 24. Each tab 74 is long enough and is located such that it can hold a respective one of the arms 32 in the first position when release mechanism 72 is in the hold position. When release mechanism 72 is moved to the release position (by sliding it downward on body member 24), tabs 74 move out of the way of arms 32 and housings 44 to allow the arms to move to the second position. Slidability may be provided by bolts 76 extending through slots 78 and retained by nuts 80 or the like. If desired, one or more compression springs 82 may be located around bolts 76 along with a friction plate 83 to provide a loose frictional fit holding release mechanism 72 in place vertically relative to body member, but easily overcome by sliding release mechanism along body member. Also, a spring 84 may be provided within body member 24 to provide a return force urging release mechanism 72 toward the hold position, if desired. A gripping portion 86 on release mechanism 72 may also be provided for moving release mechanism vertically relative to body member 24.

To deploy deflator 10 for a traffic stop, one would pick up the deflator by handle portion 28 with arms 32 in the first (upright) position and walk toward the stopped vehicle. When near the tire of the vehicle, the user would push downward on gripping portion 86 of release mechanism 72 thereby allowing arms to fall to the second (deployed) position. The user would then locate deflator 10 alongside the tire with body member 24 generally aligned with the tire axle and puncturing members alongside the tread surface 18. The user would then place base member 20 on the ground completing deployment of deflator 10. With some practice and advance study of the features and operation of deflator 10, use of the device can be intuitive. Location of gripping portion 86 of the slidable release mechanism 72 near handle portion 28 allows one-handed, "no-look" operation while maintaining visual contact with the vehicle, its occupants, the surroundings, etc. When the traffic stop is over, the process is reversed, arms 32 being returned to the upright position and release mechanism being moved back in to the holding position.

Thus, deflator 10 of the present disclosure provides an efficient and effective device that may be placed adjacent a vehicle tire during a traffic stop to deflate the tire if the vehicle drives away before the traffic stop is completed. While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

We claim:

1. A deflator deployable with a single hand of a user on the ground adjacent a tire, the deflator comprising:

a base member having a bottom surface configured for placement on the ground, the base member having a front edge facing the tire and two side edges respectively spaced oppositely along a forward-rear direction relative to the tire when the deflator is deployed adjacent the tire;

two hinge mechanisms attached to a top surface of the base member, each hinge mechanism defining a respective hinge axis extending both at a first angle of about 15 to about 45 degrees relative to the horizontal, and at a second angle of about 15 to about 45 degrees relative to a plane parallel to the forward-rear direction;

a body member having a first end attached to the base member and having a handle portion spaced upward from the base member when the bottom surface of the base member is placed on the ground;

two arms, each arm having a first end pivotally attached to a respective one of the hinge mechanisms and a second end extending away from the first end, each arm being pivotable between a first position in which the second end is located adjacent the body member and a second position in which the second end is pivoted into a position away from the body member;

each arm having a puncturing member located adjacent the second end, when the second ends of the arms are in the second position the puncturing members being spaced apart at a deploying distance more than a front-rear dimension of the tire proximate the ground; and a release mechanism located on the body member and movable from a hold position to a release position, the release mechanism including a central portion slidable relative to the body member and two tabs extending outward from the central portion, the release mechanism located adjacent and near the handle portion and sized and configured so that the release mechanism can be moved from the hold position to the release position with the hand of the user while the hand is grasping the holding portion, each tab configured to hold a respective one of the arms in the first position when the release mechanism is in the hold position and to allow the arms to move to the second position when the release mechanism is moved to the release position, movement of the arms to the second position locating the puncturing members at the deploying distance.

2. The deflator of claim 1, wherein release mechanism includes a spring member for releasably securing the release mechanism in the hold position.

3. The deflator of claim 1, wherein each hinge mechanism includes a first stop for limiting motion of the respective arm toward the first position.

4. The deflator of claim 3, wherein each hinge mechanism includes a second stop for limiting motion of the respective arm toward the second position.

5. The deflator of claim 1, wherein each arm has a length from the first end to the puncturing member of about 15.0 to about 24.0 inches.

6. The deflator of claim 5, wherein the first angle is about 30 degrees, the second angle is about 30 degrees, and the length of the arms is about 18.0 inches.

7. The deflator of claim 1, wherein at least one of the puncturing members is removably secured to the respective arm.

8. The deflator of claim 7, wherein the at least one of the puncturing members is removably secured by a magnet with force low enough to allow the puncturing member to be removed from the second end by the tire after the tire drives across the second end.

9. The deflator of claim 1, wherein at least one of the puncturing members includes a tube with a central opening sized to allow the tire to be deflated via central opening after the tire drives across the second end.

* * * * *